US006062383A

United States Patent [19]

Han

[11] Patent Number: 6,062,383

[45] Date of Patent: May 16, 2000

[54] GOLF BAG WITH SUPPORT STAND

[76] Inventor: Dong Kyu Han, 37 Bethany Dr., Irvine, Calif. 92612

[21] Appl. No.: 09/022,283

[22] Filed: Feb. 11, 1998

[51] Int. Cl.[7] ..... A63B 55/00; A63B 55/06; A63B 55/10

[52] U.S. Cl. ..... 206/315.7; 206/315.3; 248/96

[58] Field of Search ..... 206/315.3, 315.7, 206/315.8; 248/96

[56] References Cited

U.S. PATENT DOCUMENTS

| | | | |
|---|---|---|---|
| 1,757,471 | 5/1930 | Platt | 248/96 |
| 2,430,107 | 11/1947 | Cronrath | 214/65 |
| 4,620,682 | 11/1986 | Yim | 248/96 |
| 4,834,235 | 5/1989 | Solheim et al. | 206/315.7 |
| 4,921,192 | 5/1990 | Jones | 248/96 |
| 5,152,483 | 10/1992 | Maeng | 248/96 |
| 5,154,377 | 10/1992 | Suk | 248/96 |
| 5,186,424 | 2/1993 | Shultz et al. | 248/179 |
| 5,209,350 | 5/1993 | Maeng | 206/315.7 |
| 5,340,063 | 8/1994 | Hsieh | 248/96 |
| 5,415,285 | 5/1995 | Reimers | 206/315.7 |
| 5,464,180 | 11/1995 | Cheng | 248/96 |
| 5,507,384 | 4/1996 | Maeng | 206/315.7 |
| 5,516,064 | 5/1996 | Hsieh | 248/96 |
| 5,549,263 | 8/1996 | Maeng | 248/96 |
| 5,607,128 | 3/1997 | Suk | 248/96 |
| 5,762,189 | 6/1998 | Reimers | 206/315.7 |
| 5,799,786 | 9/1998 | Beck et al. | 206/315.7 |

*Primary Examiner*—Sue A. Weaver
*Attorney, Agent, or Firm*—Jonathan Y. Kang; Lee & Hong

[57] ABSTRACT

A golf bag with a support stand has a bag body, a base member coupled to and enclosing a lower portion of the bag body. The base member has a first plate and a second plate pivotally coupled to each other. The golf bag further includes a mount which is secured to the golf bag and has a first set of engaging members. The legs of the support stand has a second set of engaging members. The legs are respectively and pivotally attached to the first set of engaging members of the mount. The golf bag also has an actuating member which has lower and upper members. The upper member is pivotally connected to the second set of engaging members of the legs. The lower member is coupled to the first plate of the base member so that when the first plate is at an angle with respect to the second plate, the actuating member actuates the legs to an extended position. The first and second plates of the base member are connected with at least one hinge. The first plate has a first wall and the second plate has a second wall. Both first and second walls have inclined ends at a predetermined angle such that the angle of the inclined ends determines the pivoting angle of the first plate with respect to the second plate.

17 Claims, 4 Drawing Sheets

GOLF BAG WITH SUPPORT STAND

BACKGROUND OF THE INVENTION

1. Field of the Invention

This invention relates to a golf bag having a support stand, and more particularly to a golf bag with extendable and retractable support stand which operates in cooperation with a base member of the golf bag to support the golf bag at an angle.

2. Description of Related Art

Golf is one of the most widely played sports activities in the United States. Not only is this activity already widespread, but the number of golfers continue to grow due to popularity of the sports caused by high stake games televised on televisions.

The sport of golf is typically played with a set of golf clubs which are commonly placed in a golf bag. When a golf bag is carried by a golfer, it is desirable to include a stand which supports the golf bag in its upright position to allow easy access to the golf clubs. Conventionally, this function has been accommodated by providing legs which are extendable when the golf bag is placed on the ground and retractable when the golf bag is carried.

Various methods have been used to move the legs between their retracted and extended positions. One method is described in U.S. Pat. No. 5,154,377 to Suk (the "Suk reference"). In the Suk reference, before a pair of legs can be used to support a golf bag, a slide member must be moved in a descending position along a two parallel groove track formed in a slide bracket. When the extending feature of the legs are not needed, the user must then manually move the slide member in an upward position along the track. The manual operation of the sliding member may be cumbersome to some golfers.

Another conventional golf bag stand is described in U.S. Pat. No. 5,152,483 to Maeng (the "Maeng reference"). In the Maeng reference, the pair of legs extend away from the golf bag to provide support when the golf bag is forcefully tilted with respect to the ground. In such a position, the contact surface area of the golf bag with the ground is minimal, which comprises the tips of two legs and an outer edge of the golf bag, and thus possibly causing the golf bag to tip over when it is placed on a slope or irregular surface. In addition, a horizontal drive member pivotally mounted to a base of the golf bag in the Maeng reference must be sufficiently rigid and large to withstand the tilting force, because the drive member must provide all of the actuating force to the U-shaped actuating member.

Moreover, conventional golf bags that are equipped with support stands have a plastic piece which is coupled to and extends out of the base of the golf bag. The plastic piece is connected to the support stand and is used to extend or retract the support stand. Such protruding plastic piece causes difficulty in handling golf bags, especially when installing them in golf carts. Further, the plastic piece is easily broken or otherwise damaged, thus rendering the support stand useless or inoperable.

SUMMARY OF THE DISCLOSURE

Accordingly, it is an object of the present invention to provide a golf bag having an integral support stand which operates in cooperation with a base member of the golf bag to actuate the support stand to support the golf bag at an acute angle.

It is a further object of the present invention to provide a golf bag which the base member serves a dual purpose of supporting golf clubs and actuating the actuating rods of the support stand for extending support legs.

In accordance with the present invention, these objects can be accomplished by providing a golf bag stand suitable for use with a golf bag having a bag body. According to a first embodiment of the present invention, the golf bag with a support stand comprises a bag body, a base member coupled to and enclosing a lower end of the bag body. The base member has a first plate and a second plate pivotally coupled to each other. The golf bag further includes a mount which is secured to the golf bag and has a first set of engaging members. The legs of the support stand has a second set of engaging members. The legs are respectively and pivotally attached to the first set of engaging members of the mount. The golf bag also has an actuating member which has lower and upper members. The upper member is pivotally connected to the second set of engaging members of the legs. The lower member is coupled to the first plate of the base member so that when the first plate is at an angle with respect to the second plate, the actuating member actuates the legs to an extended position.

According to one aspect of the first embodiment, the first and second plates of the base member are connected with at least one hinge. Alternatively, the first and second plates of the base member may be formed as one integrated piece.

Preferably, the first plate has a first wall and the second plate has a second wall. Both first and second walls have inclined or angled ends having a predetermined angle such that the angle of the inclined ends determines the pivoting angle of the first plate with respect to the second plate.

The first plate of the base member has a connector for engaging the lower member of the actuating member. It is also possible that the base member and the connector are formed as an one-piece member.

According to a second embodiment of the present invention, at least one of the first and second walls has a smaller diagonal width to allow the first plate to pivot with respect to the second plate. For example, the first plate of the base member has a first wall and the second plate has a second wall, in which the second wall is disposed in surrounding relation and substantially parallel to the first wall to allow the first plate to pivot with respect to the second plate. The first wall has a connector which is coupled to the actuating member.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
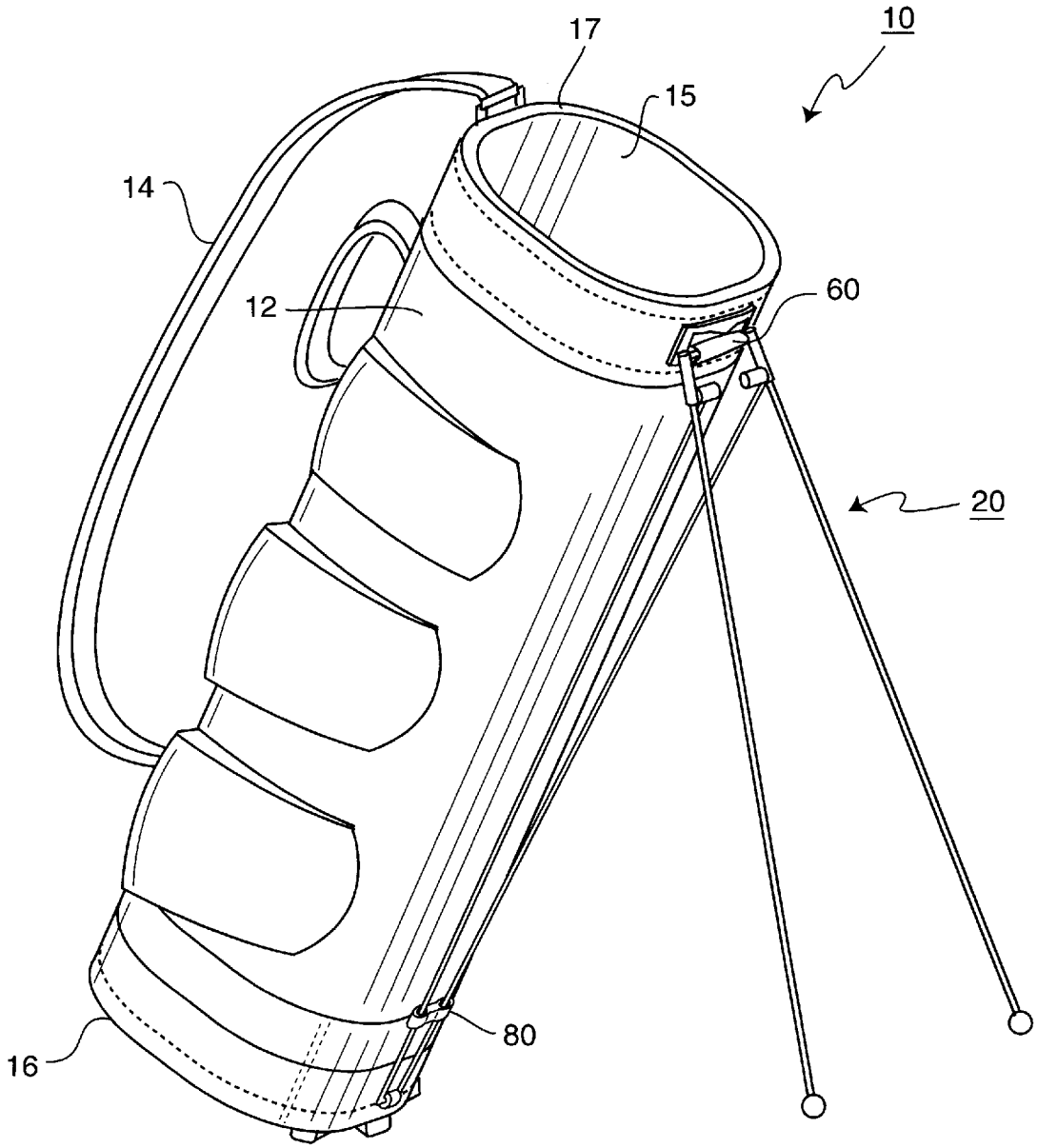
FIG. 1 illustrates a perspective view of a golf bag stand according to a first embodiment of the present invention.

A golf bag with a support stand according to various embodiments of the present invention is shown in the drawings for purposes of illustration. Referring to FIG. 1, there is shown a golf bag 10 which has a bag body 12 provided with a shoulder strap 14, a support stand assembly 20 and a base member 16. The support stand assembly 20 is mounted on the exterior of the bag body 12 preferably on the opposite side from the shoulder strap 14, as illustrated in FIG. 1. The support stand assembly 20 is mounted on a top cylindrical member 17 which defines a top opening 15.

In a first embodiment, the bag body 12 is of a substantially cylindrical shape with the top opening 15 for receiving golf clubs and a base member 16 which fully encloses the lower opening of the bag body 12. The bag body 12 is made of any resilient and light weight material, such as plastic, nylon or canvas. The top portion of the bag body 12 includes a top member 17, preferably made with any cylindrically hollow and rigid material, such as injection molded plastic, and is secured to the bag body 12 to define the top opening 15. The base member 16 encloses the bottom opening of the bag body 12. The base member 16 is preferably made with plastic or other suitably light weight materials to provide a firm bottom support to the bag body 12 and to support golf clubs.

Figure 2:
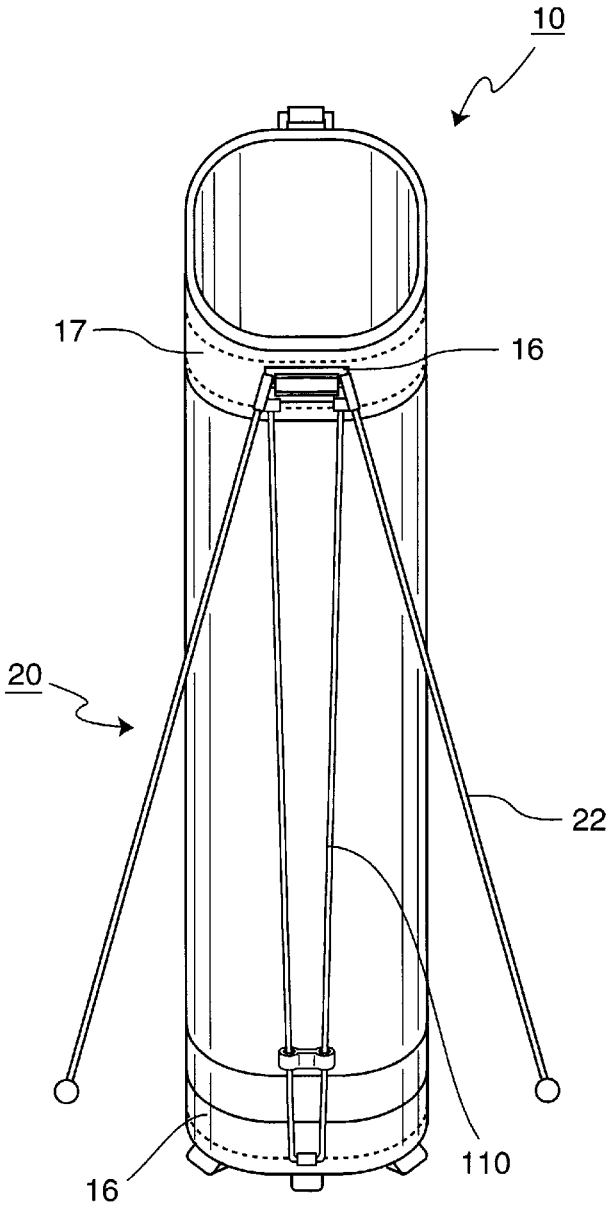
FIG. 2 is a front elevation view of FIG. 1.

Referring to FIG. 2, there shown is a front elevation view of the support stand assembly 20 according to the first embodiment of the present invention. Attached to the top member 17 is a mount 60. The mount 60 is fixedly mounted on the top member 17 at a suitable elevation, preferably toward the upper portion of the golf bag 10. In the first embodiment, the mount 60 is installed on the top member 17 using any fastener, such as screws or rivets, or it may even be stitched on to the top member 17.

Figure 3:
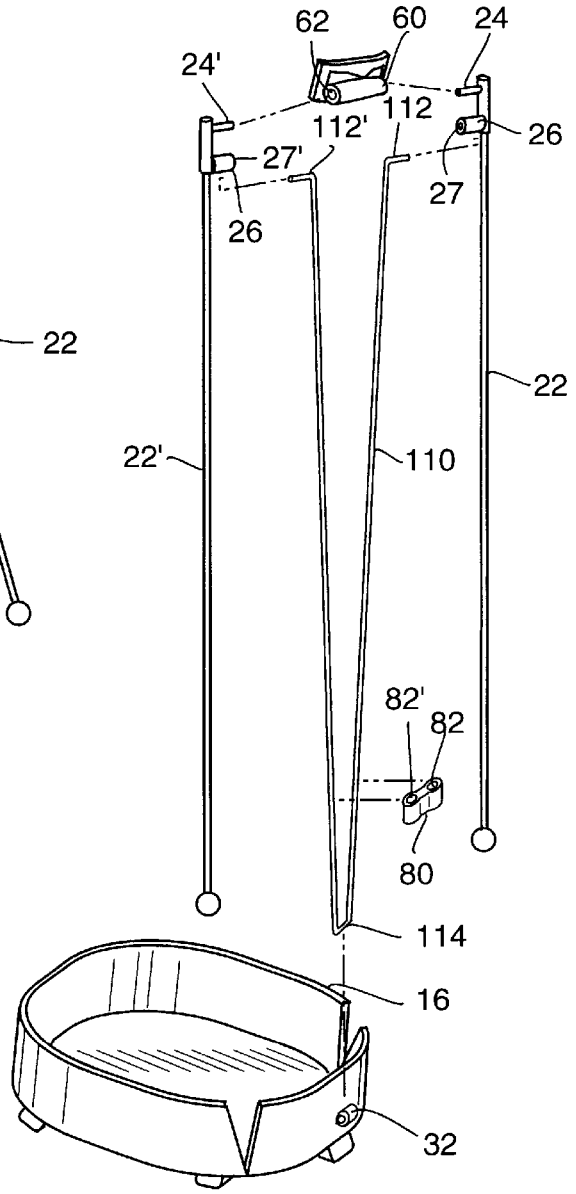
FIG. 3 is an exploded view of the golf bag stand as shown in FIG. 1.

FIG. 3 illustrates an exploded view of the golf stand 20. The mount 60 includes two oppositely positioned axle holes 62 (one of the axle holes is not shown in FIG. 3) disposed in a substantially horizontal direction, open at respective outer ends. The support stand 20 according to the first embodiment has two legs 22 and 22', each leg having a pin 24 or 24' substantially perpendicularly disposed near the top end and respectively fitted into the axle holes 62 in the mount 60. As a result, the two legs 22 and 22' extend away from or retract toward the bag body 12 by a pivoting action at the axle holes 62. Each leg 22 or 22' has a bore casing 26 or 26' with a through bore 27 or 27' for mounting an actuating member 110.

The actuating member 110 has two opposing ends 112 and 112' disposed at the same elevation and respectively inserted through the through bores 27 and 27' in the bore casings 26 and 26'. The position of the actuating member 110 with respect to the through bores 27 and 27' is better illustrated in FIG. 1. The actuating member 110 is preferably made of a resilient metal rod and is formed of a substantially U-shape. The actuating member 110 may be made of steel, fiberglass, or other suitable composite materials. The actuating member 110 has a base portion 114 equally spaced from the two opposite ends 112 and 112'. The base portion 114 is hooked to a connector 32 of the base member 16. The guiding bracket 80, which is slidably coupled to the actuating member 110, has two holes 82 and 82', for receiving respective legs 22 and 22' of the actuating member 110. The guiding bracket 80 prevents the legs 22 and 22' from bending or flexing outwards.

Figure 4:
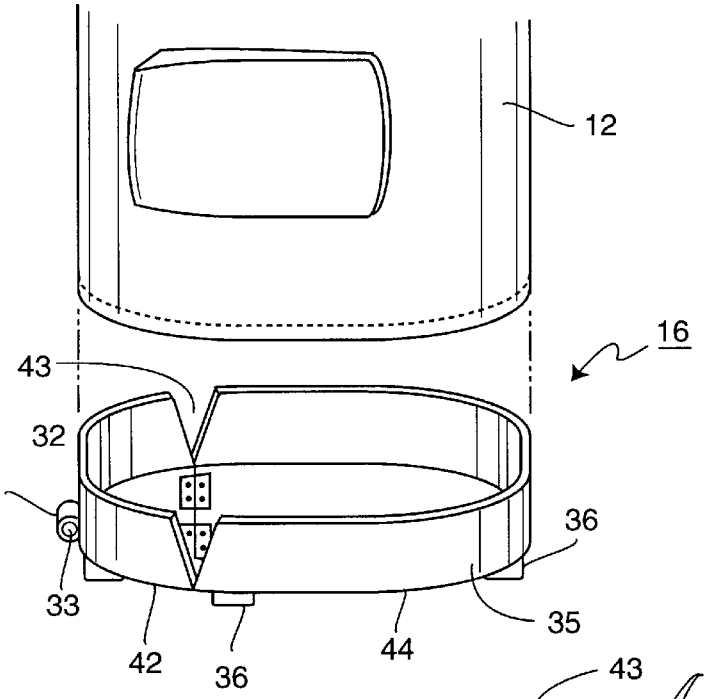
FIG. 4 illustrates the lower portion of the golf bag stand which particularly illustrates the construction of the base member according to the first embodiment of the present invention.
Figure 5:
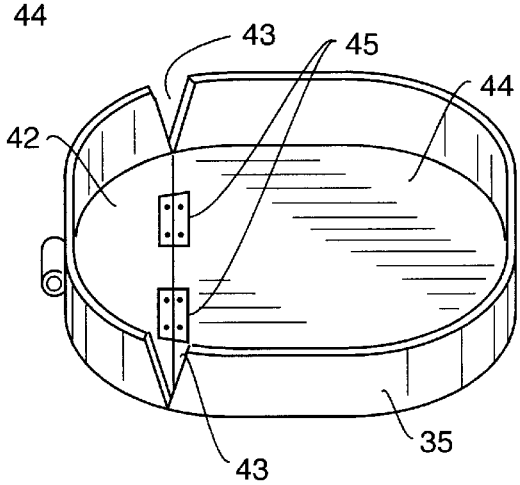
FIG. 5 illustrates a perspective view of the base member according to the first embodiment of the present invention.

FIGS. 4 and 5 illustrate a base member 16 according to the first embodiment of the present invention. The base member 16 is formed of a substantially elliptical or circular plate which matches the cross-sectional shape of the bag body 12. The base member 16 also includes side walls 35 which are erected substantially perpendicularly from the outer periphery of the plate defining the base member 16. Preferably, the bag body 12 is disposed in a surrounding relation to the side walls 35 of the base member 16 to substantially cover the side walls or outer shell of the base member 16. Alternatively, the bag body 12 may be disposed within the side walls 35 of the base member 16. The base member 16 may be comprised of a first plate 42 and a second plate 44 which are pivotally connected together with hinges 45. The hinges 45 allow the first plate 42 and the second plate 44 to pivot inwardly with respect to each other, while preventing them from pivoting outwardly.

To allow the first plate 42 and the second plate 44 to pivot, matching gaps 43 are formed on generally opposite side of each other, as shown in FIG. 5. The angle of the gaps 43 dictates the tilting angle of the golf bag 10. Preferably, each one of the gaps 43 may be formed to have an approximate angle of 20–35 degrees. When the golf bag 10 is tilted forward, the bending of the base member 16 causes the bag body 12 to crease near the proximity of the gaps 43, thus, creating wrinkles near the lower extremities of the golf bag 10. Although not illustrated in the drawings, a thin layer of flexible material, preferably water resistant, may be lined around the gaps 43 to prevent water from entering into the golf bag 10. Alternatively, instead of the gaps 43, the side walls of the first and second plates may be joined together where such joint is made of a crease wall.

The first plate 42 of the base member 16 has a connector 32 for engaging the base portion 114 of the actuating member 110. The diameter of the hole 33 defined by the connector 32 is preferably slightly larger than that of the cross-section of the base portion 114 of the actuating member 110 to allow free pivoting movement of the base portion 114. Preferably, the connector 32 and the base member 16 are formed as one-piece mold. Alternatively, the connector 32 may be separately formed and attached to the first plate 42 with any suitable fastener, such as rivets, screws or adhesives. On the bottom surface of the base member 16, there is a plurality of pads 36 to support the base member 16. The plurality of pads 36 may be formed as one-piece construction with the base member 16.

Alternatively, in lieu of using the hinges 45 to allow the pivoting action of the first plate 42 with respect to the second plate 44, the two plates 42 and 44 may be formed as one plastic piece where the joining line is preferably molded thinner than the rest of the base member 16. The thinner joint allows the first plate 42 to pivot with respect to the second plate 44.

Figure 6:
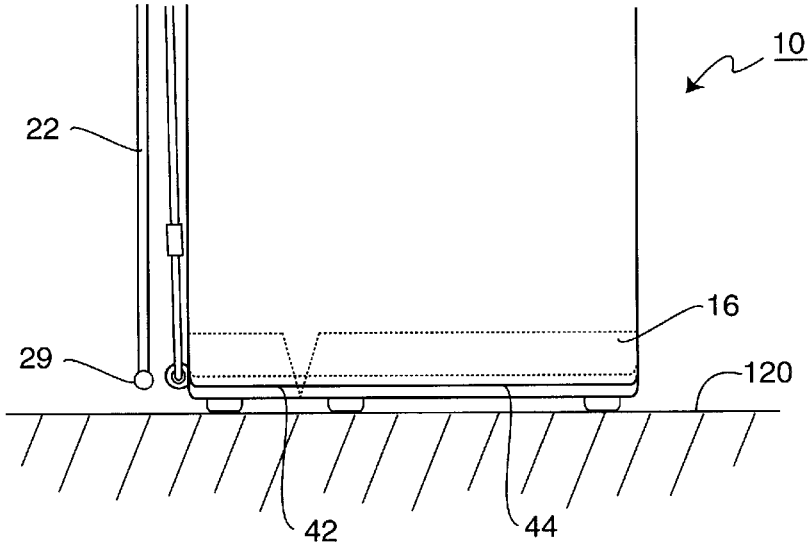
FIG. 6 illustrates the golf bag and a support stand in an upright position.
Figure 7:
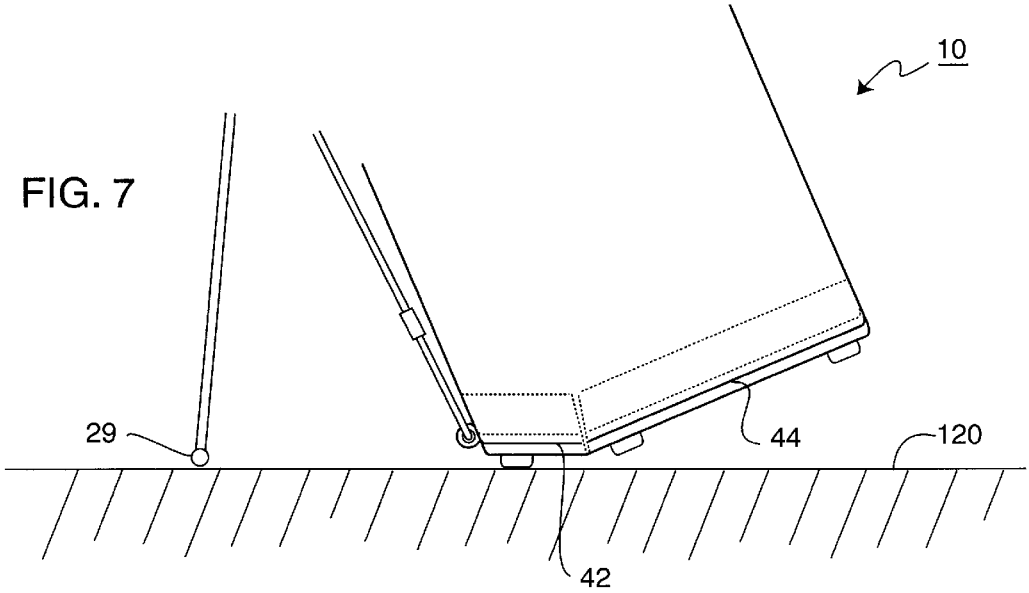
FIG. 7 illustrates the golf bag and a support stand in a tilted position.

FIGS. 6 and 7 illustrate the operation of the support stand assembly 20 according to the first embodiment. The legs 22 and 22' of the golf bag 10 are normally in their retracted position which is adjacent to the side of the golf bag 10, as shown in FIG. 6. In this position, the golf bag 10 is supported by the entire base member 16. Thus, the base member 16 substantially makes a full contact with the ground surface 120. To bring the legs 22 and 22' into their extended position, such as when a golfer places the golf bag 10 on the ground, the support stand 20 side or the front side of the golf bag 10 is tilted toward the surface 120, which in turn pivots or tilts the front plate 42 of the base member 16 with respect to the rear plate 44. This is accomplished by tilting the golf bag 10 and maintaining the front plate 42 of the base member 16 to be approximately parallel with the ground and until the bottom 29 of the actuating member 110 is in contact with the ground.

Figure 8:
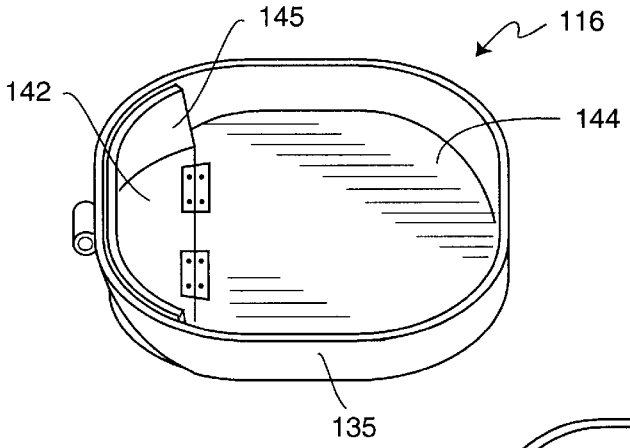
FIG. 8 illustrates a side perspective view of the base member according to a second embodiment of the present invention.
Figure 9:
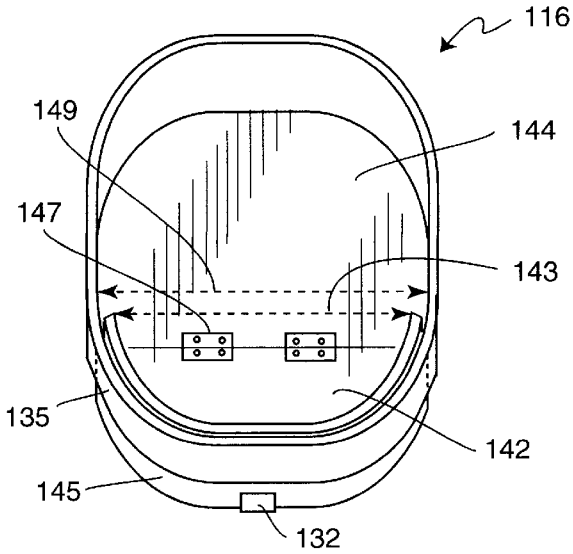
FIG. 9 illustrates a front perspective view of the base member of FIG. 8.

FIGS. 8 and 9 illustrate perspective views of a second embodiment of the present invention. The construction of the base member 116 of the second embodiment is similar to that of the first embodiment. Instead of having the gaps 43 formed by the wall of the first and second plates 42 and 44, as shown in FIG. 4, the side walls of the plates may be formed so that they are staggered or overlap with respect to each other. For example, as shown in FIG. 8, the separation (diagonal length 143) of the opposite side walls of the first plate 142 may be constructed narrower than the diagonal length 149 of the second plate 144 so that when the first plate 142 is pivoted with respect to the second plate 144, the walls of the first plate 142 are spatially disposed inside the second plate 144.

The base member 116 according to the second embodiment has a side wall 135 which fully encloses both the first and second plates 142 and 144. The side wall 135 is preferably an extension of a wall connected to and erected from the second plate 144. In other words, a first or front wall 145 is erected around a periphery of the first plate 142 and a second or side wall 135 is erected around a periphery of the second plate 144 and in surrounding relation to the front wall 145. Preferably, the bag body is coupled to the side wall 135 of the base member 116 to enclose the bottom opening of the bag body while allowing the first plate 142 to pivot with respect to the second plate 144.

The side wall 135 is disposed substantially adjacent and parallel to a front wall 145 which is connected to and erected from the first plate 142. The height of the side wall 135 is tapered from the front to the side to allow the pivoting movement of the first plate 142 with respect to the second plate 144. To permit the maximum vertical movement of the first plate 142, the height of the side wall 135 located immediately above the connector 132 is preferably the shortest. The height is gradually increased and tapered as the side wall 135 gets closer to the second plate 144.

The hollow body of the golf bag may be directly stitched, or otherwise secured, onto and around the side wall 135 of the base member 116. As a result, the golf bag has a better esthetic appearance since there is no wrinkling around the pivoting point of the first and second plates 142 and 144. Alternatively, the portion of the side wall 135 enclosing the first plate 142 and the front wall 145 may be eliminated so that the body of the golf bag is stitched directly to the front wall 145 of the first plate 142.

To prevent any fluid from entering inside the golf bag, the inside of the base member 116 may be lined with a water proof flexible lining, such as fabric or plastic.

Alternative to the hinges 147 used in the second embodiment, the two plates 142 and 144 may be formed as one plastic piece where the joining line is preferably thinner than the rest of the base member 116. The thinner joint allows the first plate 142 to pivot with respect to the second plate 144.

Further, the side wall 135 of the base member 116 may be fully enclosed with a resilient material, preferably the same material as the side wall 135, so that the golf clubs are placed thereon. In other words, the enclosure of the side wall 135 functions as the bottom wall of the golf bag with the first and second plates 142 and 144 of the base member 116 disposed immediately below.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf bag with a stand comprising:

a bag body;

a base member coupled to and enclosing a lower portion of the bag body, the base member having a first plate and a second plate pivotally coupled to each other, wherein the first plate has a first wall and the second plate has a second wall, both first and second walls having inclined ends at a predetermined angle such that the angle of the inclined ends determines a pivoting angle of the first plate with respect to the second plate;

a mount secured to the golf bag, the mount having a first set of engaging members;

legs having a second set of engaging members, wherein the legs are respectively and pivotally attached to the first set of engaging members of the mount; and an actuating member having lower and upper members, wherein the upper member is pivotally connected to the second set of engaging members of the legs, and the lower member is coupled to the first plate of the base member so that when the first plate is at an angle with respect to the second plate, the actuating member actuates the legs to an extended position.

2. A golf bag of claim 1, wherein the first and second plates of the base member are connected with at least one hinge.

3. A golf bag of claim 1, wherein the first plate of the base member has a connector for engaging the lower member of the actuating member.

4. A golf bag with a stand comprising:

a bag body;

a base member coupled to and enclosing a lower portion of the bag body, the base member having a first plate and a second plate pivotally coupled to each other, wherein a first wall is erected around a periphery of the first plate and a second wall is erected around a periphery of the second plate;

legs pivotally attached to the bag body and moves between an extended position and a retracted position; and an actuating member having lower and upper members, wherein the upper member is pivotally connected to the legs, and the lower member is coupled to the first plate of the base member so that when the first plate is at an angle with respect to the second plate, the actuating member actuates the legs to the extended position with respect to bag body, wherein at least one of the first and second walls having inclined ends at a predetermined angle such that the angle of the inclined ends determines a pivoting angle of the first plate with respect to the second plate.

5. A golf bag of claim 4, wherein the first and second plates of the base member are connected with at least one hinge.

6. A golf bag of claim 4, wherein the first and second plates of the base member are formed as one integrated piece.

7. A golf bag of claim 4, wherein the first plate of the base member has a connector for engaging the lower member of the actuating member.

8. A golf bag with a stand comprising:

a bag body:

a base member coupled to and enclosing a lower portion of the bag body, the base member having a first plate and a second plate pivotally coupled to each other, wherein a first wall is erected around a periphery of the first plate and a second wall is erected around a periphery of the second plate;

legs pivotally attached to the bag body and moves between an extended position and a retracted position; and an actuating member having lower and upper members, wherein the upper member is pivotally connected to the legs, and the lower member is coupled to the first plate of the base member so that when the first plate is at an angle with respect to the second plate, the actuating member actuates the legs to the extended position with respect to bag body, wherein a separation distance of opposite walls of the first wall is smaller than that of the second wall so that the first plate pivots with respect to the second plate.

9. A golf bag of claim 8, wherein the second wall is disposed in surrounding relation and substantially parallel to the first wall to allow the first plate to pivot with respect to the second plate.

10. A golf bag of claim 9, further including a connector secured to the first wall, the connector being coupled to the actuating member.

11. A golf bag of claim 9, further including a connector secured to the first wall, the connector being coupled to the actuating member.

12. A golf bag of claim 8, wherein the first and second plates of the base member are connected with at least one hinge.

13. A golf bag of claim 8, wherein the first and second plates of the base member are formed as one integrated piece.

14. A golf bag of claim 8, wherein the first plate of the base member has a connector for engaging the lower member of the actuating member.

15. A golf bag with a stand comprising:

a bag body defining top and bottom openings;

a base member having a first plate and a second plate pivotally coupled to each other, wherein a first wall is erected around a periphery of the first plate and a second wall is erected around a periphery of the second plate and in surrounding relation to the first wall, the bag body being coupled to the second wall of the base member to enclose the bottom opening of the bag body while allowing the first plate to pivot with respect to the second plate;

a mount secured to the golf bag, the mount having a first set of engaging members;

legs having a second set of engaging members, wherein the legs are respectively and pivotally attached to the first set of engaging members of the mount; and an actuating member having lower and upper members, wherein the upper member is pivotally connected to the second set of engaging members of the legs, and the lower member is coupled to the first wall of the first plate of the base member so that when the first plate is at an angle with respect to the second plate, the actuating member actuates the legs to an extended position.

16. A golf bag of claim 15, wherein a height of the second wall immediately above where the lower member of the actuating member is connected to the first wall is short to allow a vertical movement of the first plate with respect to the second plate.

17. A golf bag of claim 15, wherein the first and second plates of the base member are connected with at least one hinge.

* * * * *